US012359330B2

(12) United States Patent
de Resende et al.

(10) Patent No.: US 12,359,330 B2
(45) Date of Patent: Jul. 15, 2025

(54) MOLTEN OXIDE ELECTROLYSIS METHODS AND RELATED SYSTEMS

(71) Applicant: Boston Electrometallurgical Corporation, Woburn, MA (US)

(72) Inventors: Itamar Dutra Pereira de Resende, Santa Cruz de Minas (BR); Breno Rezende, Tiradentes (BR); Rakan Ashour, Burlington, MA (US); Guillaume Lambotte, Somerville, MA (US)

(73) Assignee: Boston Electrometallurgical Corporation, Woburn, MA (US)

( * ) Notice: Subject to any disclaimer, the term of this patent is extended or adjusted under 35 U.S.C. 154(b) by 0 days.

(21) Appl. No.: 18/673,987

(22) Filed: May 24, 2024

(65) Prior Publication Data

US 2024/0392457 A1 Nov. 28, 2024

Related U.S. Application Data

(60) Provisional application No. 63/504,442, filed on May 25, 2023.

(51) Int. Cl.

| | |
|---|---|
| ***C25C 3/00*** | (2006.01) |
| ***C25C 3/34*** | (2006.01) |
| ***C25C 5/04*** | (2006.01) |
| ***C25C 7/00*** | (2006.01) |
| ***C25C 7/06*** | (2006.01) |

(52) U.S. Cl.

CPC ..... *C25C 7/06* (2013.01); *C25C 3/34* (2013.01); *C25C 7/005* (2013.01)

(58) Field of Classification Search

CPC .. C25C 7/06; C25C 3/34; C25C 7/005; C25C 3/00; C25C 5/04

See application file for complete search history.

(56) References Cited

U.S. PATENT DOCUMENTS

| | | | |
|---|---|---|---|
| 4,906,290 | A | 3/1990 | Worner |
| 5,286,353 | A | 2/1994 | Wilkening |
| 5,567,286 | A | 10/1996 | Pal et al. |
| 11,591,703 | B2 | 2/2023 | Hyers et al. |
| 2004/0011660 | A1 | 1/2004 | Bradford et al. |

(Continued)

FOREIGN PATENT DOCUMENTS

WO 2023286061 A1 1/2023

OTHER PUBLICATIONS

Chase , "NIST-JANAF Themochemical Tables", Fourth Edition, Journal of Physical and Chemical Reference Data, 1998, 61 pages.

(Continued)

*Primary Examiner* — Zulmariam Mendez

(74) *Attorney, Agent, or Firm* — Kilpatrick Townsend & Stockton LLP

(57) ABSTRACT

Molten oxide electrolysis may be used for extracting one or more metals from a mixture of metal oxides. The mixture of metal oxides may be complex and include at least three metal oxides, each present at 0.5 wt % or greater based on a total weight of the metal oxide electrolyte precursor, to produce a metal oxide electrolyte. In some instances, two or more metals may be extracted in a series of molten oxide electrolysis process where metal oxides having higher Gibbs free energy of formation at 1500° C. are preferentially reduced in each respective molten oxide electrolysis unit before metal oxides having lower Gibbs free energy of formation at 1500° C.

19 Claims, 3 Drawing Sheets

(56) References Cited

U.S. PATENT DOCUMENTS

| | | | |
|---|---|---|---|
| 2004/0112757 | A1 | 6/2004 | Siljan et al. |
| 2007/0215483 | A1 | 9/2007 | Johansen et al. |
| 2007/0295609 | A1 | 12/2007 | Jeong et al. |
| 2010/0314260 | A1 | 12/2010 | Fujita et al. |
| 2012/0043220 | A1 | 2/2012 | Allanore et al. |
| 2012/0292198 | A1 | 11/2012 | Derezinski et al. |
| 2013/0153434 | A1 | 6/2013 | Allanore et al. |
| 2020/0248326 | A1 | 8/2020 | Hyers et al. |
| 2020/0263313 | A1 | 8/2020 | Hyers et al. |
| 2022/0145484 | A1 | 5/2022 | Wang et al. |

OTHER PUBLICATIONS

PCT/US2024/030704, "International Search Report and Written Opinion", dated Oct. 11, 2024, 12 pages.
PCT/US2024/030704, "Invitation to Pay Additional Fees and, Where Applicable, Protest Fee", dated Jul. 30, 2024, 2 pages.

MOLTEN OXIDE ELECTROLYSIS METHODS AND RELATED SYSTEMS

CROSS-REFERENCES TO RELATED APPLICATIONS

This application claims the benefit of and priority to U.S. Provisional Patent Application No. 63/504,442, filed on May 25, 2023, the content of which is hereby incorporated by reference in its entirety.

BACKGROUND OF THE INVENTION

Extractive metallurgy technologies separate commercially valuable metals from their ores based on the chemical and/or physical properties of the target metal. Common extractive metallurgy technologies involve one or more of: several refining steps, process water, hazardous chemicals, and expensive chemicals like precious-metal catalysts. Further, during extraction these technologies, as well as mining process operations, often generate high volumes of waste streams that contain complex metal oxide compositions with a low concentration (e.g., 10 wt % or less, 5 wt % or less, 3 wt % or less, or 0.5 wt % or less) of valuable metals. The further extraction of said valuable minerals by common extractive metallurgy technologies is often not economically or environmentally viable.

BRIEF SUMMARY OF THE INVENTION

A method for performing molten oxide electrolysis of the present disclosure may comprise: providing a metal oxide electrolyte precursor comprising at least six metal oxides, each present at 1 wt % or greater based on a total weight of the metal oxide electrolyte precursor; conditioning the metal oxide electrolyte precursor, to produce a metal oxide electrolyte, wherein the conditioning comprises at least one of: (a) changing a concentration of at least one the at least six metal oxides in the metal oxide electrolyte precursor and (b) changing a concentration of at least one metal in a metal oxide electrolyte precursor; and performing molten oxide electrolysis on the metal oxide electrolyte as an electrolyte to produce (a) a spent electrolyte having a reduced concentration of a first metal oxide of the at least six metal oxides as compared to a concentration of the first metal oxide in the metal oxide electrolyte, and (b) a metal product comprising a first metal of the first metal oxide.

A method for extracting metal from a complex metal oxide electrolyte of the present disclosure may comprise: changing a concentration of at least one metal oxide in a metal oxide electrolyte precursor comprising at least six metal oxides, each present at 1 wt % or greater based on a total weight of the metal oxide electrolyte precursor, to produce a metal oxide electrolyte; and performing electrolysis with the metal oxide electrolyte in a molten oxide electrolysis unit to extract a metal of one or more of the metal oxides of the metal oxide electrolyte.

A method for performing molten oxide electrolysis of the present disclosure may comprise: providing a metal oxide electrolyte precursor comprising at least three metal oxides, each present at 0.5 wt % or greater based on a total weight of the metal oxide electrolyte precursor; conditioning the metal oxide electrolyte precursor, to produce a metal oxide electrolyte, wherein the conditioning comprises at least one of: (a) changing a concentration of at least one the at least three metal oxides in the metal oxide electrolyte precursor and (b) changing a concentration of at least one metal in a metal oxide electrolyte precursor; and performing molten oxide electrolysis on the metal oxide electrolyte as an electrolyte to produce (a) a spent electrolyte having a reduced concentration of a first metal oxide of the at least three metal oxides as compared to a concentration of the first metal oxide in the metal oxide electrolyte, and (b) a metal product comprising a first metal of the first metal oxide.

A method for extracting metal from a complex metal oxide electrolyte of the present disclosure may comprise: changing a concentration of at least one metal oxide in a metal oxide electrolyte precursor comprising at least three metal oxides, each present at 0.5 wt % or greater based on a total weight of the metal oxide electrolyte precursor, to produce a metal oxide electrolyte; and performing electrolysis with the metal oxide electrolyte in a molten oxide electrolysis unit to extract a metal of one or more of the metal oxides of the metal oxide electrolyte.

A method for performing molten oxide electrolysis of the present disclosure may comprise: providing a metal oxide electrolyte comprising a first metal oxide, a second metal oxide, and a third metal oxide, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C.; performing a first molten oxide electrolysis on the metal oxide electrolyte to produce (a) a first spent electrolyte comprising the second metal oxide and the third metal oxide and having a reduced concentration of the first metal oxide as compared to a concentration of the first metal oxide in the metal oxide electrolyte, and (b) a first metal product comprising a first metal of the first metal oxide; and performing a second molten oxide electrolysis on the first spent electrolyte to produce (a) a second spent electrolyte comprising the third metal oxide and a reduced concentration of the second metal oxide as compared to a concentration of the second metal oxide in the first spent electrolyte, and (b) a second metal product comprising a second metal of the second metal oxide.

A method for performing molten oxide electrolysis of the present disclosure may comprise: providing a metal oxide electrolyte comprising a first metal oxide, a second metal oxide, and a third metal oxide, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C., and wherein a $\Delta G_f$ of the second metal oxide at 1500° C. is at least 15 KJ/mole of $O_2$ greater than the $\Delta G_f$ of the third metal oxide at 1500° C.; performing a first molten oxide electrolysis on the metal oxide electrolyte to produce (a) a first spent electrolyte comprising the second metal oxide and the third metal oxide and having a reduced concentration of the first metal oxide as compared to a concentration of the first metal oxide in the metal oxide electrolyte, and (b) a first metal product comprising a first metal of the first metal oxide; and performing a second molten oxide electrolysis on the first spent electrolyte to produce (a) a second spent electrolyte comprising the third metal oxide and a reduced concentration of the second metal oxide as compared to a concentration of the second metal oxide in the first spent electrolyte, and (b) a second metal product comprising a second metal of the second metal oxide.

A molten oxide electrolysis process of the present disclosure may comprise: performing electrolysis with a metal oxide electrolyte in a plurality of molten oxide electrolysis units connected in series, wherein each molten oxide electrolysis unit forms a respective metal product stream, and wherein metal oxides having higher $\Delta G_f$ at 1500° C. are preferentially reduced in each respective molten oxide electrolysis unit before metal oxides having lower $\Delta G_f$ at 1500° C.

DETAILED DESCRIPTION OF THE INVENTION

Figure 1:
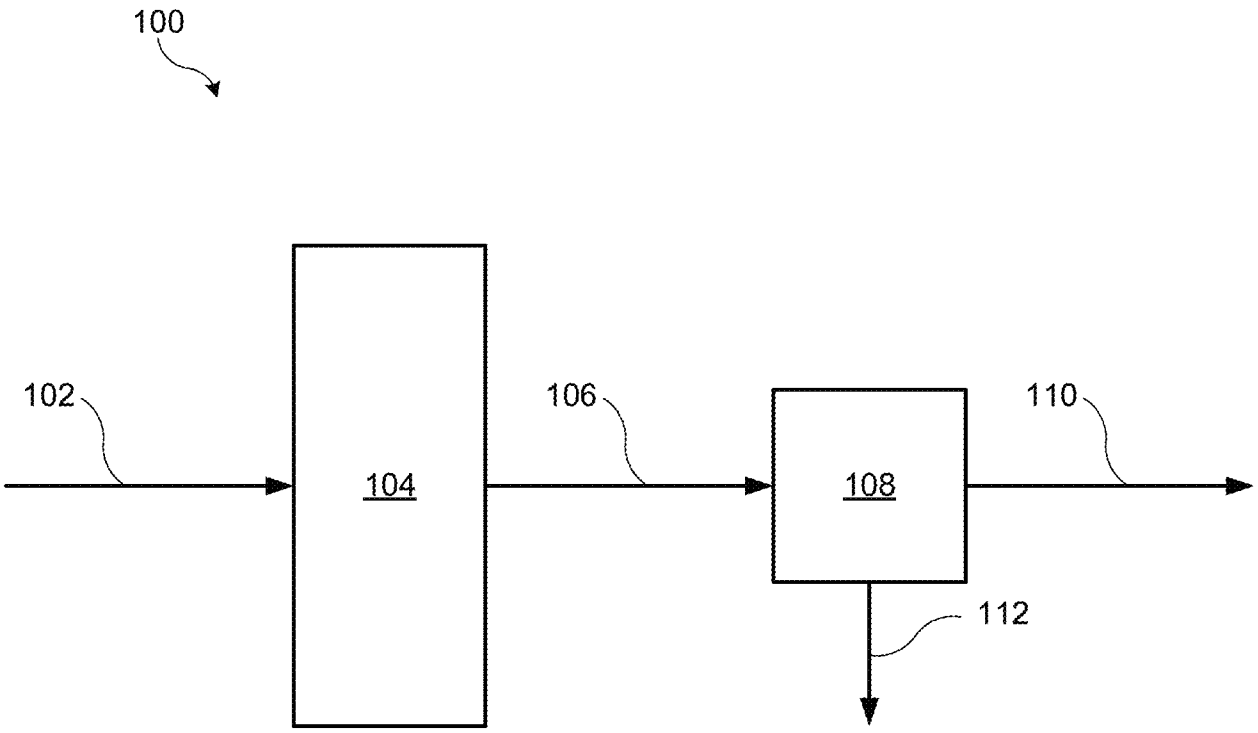
FIG. 1 is a flow diagram of a nonlimiting example of a method of the present disclosure for extracting metal from a complex metal oxide source (also referred to herein as a complex metal oxide feedstock).

Molten oxide electrolysis is a process that produces molten metal from a molten metal oxide. More specifically, current flows between an anode through a molten metal oxide electrolyte (also referred to herein as "electrolyte") to a molten metal cathode. One or more metal oxides in the molten metal oxide electrolyte are reduced to the corresponding metal(s) at the cathode, and the resulting metal(s) can accumulate in the molten metal cathode. The anode produces a gas (e.g., $O_2$, CO, $CO_2$, or a combination thereof).

Advantageously, molten oxide electrolysis can effectively and economically extract metals from a metal oxide electrolyte, even when the corresponding metal oxides are present at low concentrations in the metal oxide electrolyte. Said low concentrations are typically lower than an economically feasible concentration for other extractive metallurgy technologies. That is, while molten oxide electrolysis is capable of processing a metal oxide electrolyte with high concentrations of a target metal (e.g., 10 wt % or greater), molten oxide electrolysis advantageously can extract target metals when the metal oxides are present in the metal oxide electrolyte at low concentrations (e.g., 10 wt % or less, or 5 wt % or less, or 3 wt % or less). This is due, at least in part, to molten oxide electrolysis selectivity in reducing metal from metal oxides. Accordingly, metal oxide feedstock like waste from a mining or metallurgical process may be processed by the methods and systems described herein to extract further value from what is traditionally a waste stream.

However, not all metal oxide feedstock where molten oxide electrolysis is desired to extract the remaining valuable metal has a suitable composition for metal oxide electrolysis. As such, the metal oxide feedstock may be used as a metal oxide electrolyte precursor (rather than directly as a metal oxide electrolyte). Then, as the metal oxide electrolyte precursor, the metal oxide feedstock may be conditioned to change the physical and/or chemical properties of the metal oxide feedstock to be more suitable as a metal oxide electrolyte for molten oxide electrolysis.

Further, the metal oxide feedstock like waste streams of mining or extractive metallurgy technologies that contain complex metal oxide compositions from a variety of processes include multiple metal oxides where the extraction of said metal would provide value to the waste stream. At least some of the methods and systems of the present disclosure use multiple molten oxide electrolysis processes or reactors in series to separately extract metals from said feedstock. By using a series of molten oxide electrolysis processes, not only are valuable metals extracted, but said valuable metals may be extracted separately, which mitigates, if not eliminates, additional purification processes to use the metal product.

Metal Oxide Feedstock

Metal oxides used in the methods and systems of the present disclosure may be sourced from one or more of: mining or metallurgical waste (e.g., slags, tailings, and waste rock), a metal ore concentrate, and a metal ore. These metal oxide feedstock may be used directly as the metal oxide electrolyte in molten oxide electrolysis or may undergo conditioning (described in more detail herein) to produce a metal oxide electrolyte for molten oxide electrolysis.

The metal oxide feedstock suitable for use in the methods and systems of the present disclosure may contain at least 3 metal oxides, each present at 0.5 wt % or greater, where one or more of the at least 3 metal oxides corresponds to one or more metals targeted for extraction by molten oxide electrolysis (referred to more simply as target metals herein).

In some instances, the metal oxide feedstock may be complex. As used herein, unless otherwise specified, a metal oxide composition (e.g., a metal oxide feedstock, a metal oxide electrolyte, or a metal oxide electrolyte precursor) may be characterized as complex when the composition comprises at least three metal oxides, each present at 0.5 wt % or greater based on a total weight of the complex metal oxide composition. In some instances, a complex metal oxide composition may comprise at least six metal oxides, each present at 0.5 wt % or greater based on a total weight of the complex metal oxide composition. In some instances, a complex metal oxide composition may comprise at least six metal oxides, each present at 1 wt % or greater based on a total weight of the complex metal oxide composition.

A complex metal oxide feedstock may comprise 3 or more (or 4 or more, or 5 or more, or 6 or more, or 7 or more, or 8 or more, or 9 or more, or 10 or more, or 11 or more, or 12 or more, or 3 to 15, or 3 to 12, or 6 to 13, or 7 to 14, or 7 to 15, or 6 to 15, or 6 to 12, or 7 to 13, or 8 to 14, or 9 to 15) metal oxides, each present at 0.5 wt % or greater (or 1 wt % or greater, or 2 wt % or greater, or 5 wt % or greater) based on a total weight of the complex metal oxide feedstock.

The metal oxides in a metal oxide feedstock (complex or otherwise) may be metal oxides of alkaline and alkaline earth metals, transition metals, lanthanides, actinides, group 13 metals and metalloids, group 14 metals and metalloids, and group 15 metals and metalloids. For example, the metal oxide feedstock may comprise one or more of: $SiO_2$, MgO, $Al_2O_3$, BaO, CaO, $TiO_2$, $MoO_2$, $B_2O_3$, FeO, $Fe_2O_3$, $Fe_3O_4$, NiO, $Cu_2O$, CuO, $Cr_2O_3$, MnO, $MnO_2$, $SnO_2$, $Nb_2O_5$, $ZrO_2$, $Ta_2O_5$ $HfO_2$, $ThO_2$, $V_2O_5$, $WO_3$, and the like.

The metal oxide feedstock may further comprise one or more metals (present not as a metal oxide). The metal oxide feedstock may comprise the one or more metals each at 0.01 wt % to 20 wt % (or 0.01 wt % to 1 wt %, or 0.5 wt % to 5 wt %, or 3 wt % to 10 wt %, or 5 wt % to 20 wt %), based on a total weight of the metal oxide feedstock. A metal may be present at lower than 0.01 wt % in the metal oxide feedstock.

The one or more metals in the metal oxide feedstock (complex or otherwise) may comprise alkaline earth metals, transition metals, lanthanides, actinides, group 13 metals and metalloids, group 14 metals and metalloids, group 15 metals and metalloids. For example, the metal oxide feedstock may comprise one or more of: aluminum, manganese, titanium, copper, niobium, tantalum, iron, chromium, tin, lead, and zinc, each in an oxide form.

Table 1 provides nonlimiting examples of metal oxide feedstock.

TABLE 1

| Example | Compositions (wt % based on a total weight of the complex metal oxide feedstock) |
|---|---|
| 1 | a first metal oxide present at 20 wt % or greater (or 20 wt % to 70 wt %, or 20 wt % to 50 wt %, or 35 wt % to 70 wt %)<br>a second metal oxide present at 10 wt % or greater (or 10 wt % to 30 wt %, or 10 wt % to 25 wt %)<br>a third metal oxide present at 10 wt % or greater (or 10 wt % to 30 wt %, or 10 wt % to 25 wt %)<br>at least 3 (or at least 4, or at least 5, or at least 6, or at least 7, or 3-10, or 3-8, or 3-6, or 5-8, or 6-9, or 7-10) additional metal oxides, each present at 1 wt % or greater (or 1 wt % to 10 wt %, or 1 wt % to 5 wt %) |
| 2 | 3 metal oxides, each present at 15 wt % or greater (or 15 wt % to 50 wt %, or 10 wt % to 50 wt %, or 35 wt % to 70 wt %)<br>1 metal oxide present at 5 wt % or greater (or 5 wt % to 50 wt %, or 10 wt % to 25 wt %)<br>at least 2 (or 2-10, or 2-8, or 2-6, or 4-8, or 5-9, or 6-10) additional metal oxides, each present at 1 wt % or greater (or 1 wt % to 10 wt %, or 1 wt % to 5 wt %) |
| 3 | 25 wt % to 35 wt % $SiO_2$<br>10 wt % to 25 wt % $ZrO_2$<br>10 wt % to 20 wt % CaO<br>1 wt % to 15 wt % $Nb_2O_5$<br>1 wt % to 10 wt % $Fe_2O_3$<br>1 wt % to 10 wt % $Al_2O_3$<br>1 wt % to 10 wt % MgO<br>1 wt % to 5 wt % $Ta_2O5$<br>1 wt % to 5 wt % $ThO_2$<br>1 wt % to 5 wt % $TiO_2$<br>1 wt % to 3 wt % $HfO_2$<br>≤10 wt % other oxides |
| 4 | 25 wt % to 35 wt % $SiO_2$<br>25 wt % to 35 wt % CaO<br>5 wt % to 10 wt % MgO<br>2 wt % to 10 wt % $Al_2O_3$<br>0.5 wt % to 3 wt % FeO<br>≤10 wt % other oxides |
| 5 | 40 wt % to 70 wt % $Al_2O_3$<br>10 wt % to 30 wt % BaO<br>3 wt % to 15 wt % CaO<br>1 wt % to 10 wt % TiO2<br>≤10 wt % rare earth oxides (total)<br>≤5 wt % Nb205<br>≤5 wt % SiO2<br>≤5 wt % ZrO2<br>≤5 wt % MgO<br>≤10 wt % other oxides |
| 6 | a first metal oxide present at 20 wt % or greater (or 20 wt % to 70 wt %, or 20 wt % to 50 wt %, or 35 wt % to 70 wt %)<br>a second metal oxide present at 10 wt % or greater (or 10 wt % to 30 wt %, or 10 wt % to 25 wt %)<br>a third metal oxide present at 10 wt % or greater (or 10 wt % to 30 wt %, or 10 wt % to 25 wt %)<br>at least 3 (or at least 4, or at least 5, or at least 6, or at least 7, or 3-10, or 3-8, or 3-6, or 5-8, or 6-9, or 7-10) additional metal oxides, each present at 0.5 wt % or greater (or 1 wt % to 10 wt %, or 1 wt % to 5 wt %) |
| 7 | 3 metal oxides, each present at 15 wt % or greater (or 15 wt % to 50 wt %, or 10 wt % to 50 wt %, or 35 wt % to 70 wt %)<br>1 metal oxide present at 5 wt % or greater (or 5 wt % to 50 wt %, or 10 wt % to 25 wt %)<br>at least 2 (or 2-10, or 2-8, or 2-6, or 4-8, or 5-9, or 6-10) additional metal oxides, each present at 0.5 wt % or greater (or 1 wt % to 10 wt %, or 1 wt % to 5 wt %) |
| 8 | 20 wt % to 35 wt % $SiO_2$<br>0.5 wt % to 25 wt % $ZrO_2$<br>10 wt % to 20 wt % CaO<br>0.5 wt % to 15 wt % $Nb_2O_5$<br>0.5 wt % to 10 wt % $Fe_2O_3$<br>0.5 wt % to 10 wt % $Al_2O_3$<br>0.5 wt % to 10 wt % MgO<br>0.5 wt % to 5 wt % $Ta_2O_5$<br>0.5 wt % to 5 wt % $ThO_2$<br>0.5 wt % to 10 wt % $TiO_2$<br>0.5 wt % to 3 wt % $HfO_2$<br>≤10 wt % other oxides |
| 9 | 40 wt % to 70 wt % $Al_2O_3$<br>10 wt % to 30 wt % BaO<br>3 wt % to 15 wt % CaO<br>0.5 wt % to 10 wt % $TiO_2$<br>≤10 wt % rare earth oxides (total)<br>≤5 wt % $Nb_2O_5$ |

TABLE 1-continued

| Example | Compositions (wt % based on a total weight of the complex metal oxide feedstock) |
|---|---|
| | ≤5 wt % $SiO_2$<br>≤5 wt % $ZrO_2$<br>≤5 wt % MgO<br>≤10 wt % other oxides |

Molten Oxide Electrolysis Methods and Systems

FIG. 1 is a flow diagram of a nonlimiting example of method 100 of the present disclosure for extracting metal from a metal oxide feedstock. In the illustrated method 100, the metal oxide feedstock is a complex metal oxide feedstock and is used as a metal oxide electrolyte precursor 102 and conditioned 104 to produce a metal oxide electrolyte 106 suitable for undergoing molten oxide electrolysis 108.

The conditioning 104 may be used to modify the physical properties (e.g., melting point, density, electrical conductivity, and the like) of the metal oxide electrolyte precursor 102 and/or to modify the chemical composition of the metal oxide electrolyte precursor 102 to mitigate unwanted reactions of the metal oxide electrolyte 106 when undergoing molten oxide electrolysis 108. The conditioning 104 may include changing the composition of the metal oxide electrolyte precursor 102, which, in this example, is a complex metal oxide feedstock. The composition change can be affected by (a) changing a concentration of at least one metal oxide in the metal oxide electrolyte precursor 102, (b) changing a concentration of at least one metal in a metal oxide electrolyte precursor 102, or (c) a combination of (a) and (b). For example, (a) may include reducing one or more metal oxides into their respective metals and removing them from the metal oxide electrolyte precursor 102.

The concentration change for individual metal oxides of the at least one metal oxide may be a concentration increase (including increasing from 0.0 wt % to a concentration greater than 0.1 wt %) or a concentration decrease (including decreasing from a concentration greater than 0.1 wt % to 0.0 wt %).

Increasing the concentration of a metal oxide may include adding a metal oxide additive to the metal oxide electrolyte precursor 102. Metal oxide additives may preferably be used to adjust the physical properties of metal oxide electrolyte precursor 102, so that the metal oxide electrolyte 106 is more suitable for the molten oxide electrolysis 108 under the desired operational conditions. For example, when both $Al_2O_3$ and CaO are present, increasing the weight ratio of $Al_2O_3$ to CaO may increase the melting temperature. Accordingly, CaO may be added to the metal oxide electrolyte precursor 102 so that the metal oxide electrolyte 106 has a lower melting temperature than the metal oxide electrolyte precursor 102. In a more specific example, when both $Al_2O_3$ and CaO are present and $Al_2O_3$ is above 55 wt %, increasing the weight ratio of $Al_2O_3$ to CaO may increase the melting temperature. Accordingly, if $Al_2O_3$ is above 55 wt %, CaO may be added to the metal oxide electrolyte precursor 102 so that the metal oxide electrolyte 106 has a lower melting temperature than the metal oxide electrolyte precursor 102. Similarly, other metal oxide additives may be added to change the melting temperature or other physical properties of the metal oxide electrolyte precursor 102 during conditioning 104. In some embodiments, CaO and/or other metal oxide additives may be added in an amount sufficient to change the melting temperature (e.g., increase the melting temperature or decrease the melting temperature) of the metal oxide electrolyte precursor 102 by at least 1° C. (or at least 2° C., or at least 3° C., or at least 5° C., or at least 10° C., or at least 50° C., or at least 100° C.).

Examples of metal oxide additives may include, but are not limited to, titanium oxide, silicon oxide, magnesium oxide, aluminum oxide, calcium oxide, lime, limestone, aluminosilicates, magnesium aluminosilicates, magnesium silicates, borosilicates, iron oxides, the like, and any combination thereof. The metal oxide additives may be mixtures of the foregoing and optionally other oxides where the mixture is naturally occurring or synthetically manufactured.

Additionally, increasing the concentration of a metal oxide may include adding a metal oxide concentrate of the target metal of the molten oxide electrolysis 108. A metal oxide concentrate may comprise at least 20 wt % (or at least 20 wt %, or at least 30 wt %, or at least 40 wt %, or at least 50 wt %, or at least 60 wt %, or at least 70 wt %, or 20 wt % to 100 wt %, or 20 wt % to 75 wt %, or 20 wt % to 50 wt %, or 50 wt % to 100 wt %, or 50 wt % to 75 wt %, or 60 wt % to 80 wt %, or 70 wt % to 100 wt %) of the metal oxide corresponding to the target metal of the molten oxide electrolysis 108. Increasing the concentration of the metal oxide of the target metal may facilitate a faster initial reduction of the metal oxide of the target metal.

When a metal oxide concentration is increased using either of the foregoing additions, the concentration may be increased, for example, by an amount of 0.5 wt % to 50 wt % (or 0.5 wt % to 10 wt %, or 1 wt % to 5 wt %, or 5 wt % to 15 wt %, or 10 wt % to 20 wt %, or 15 wt % to 50 wt %), calculated as the wt % of said metal oxide in the metal oxide electrolyte (based on a total weight of the metal oxide electrolyte) minus the wt % of said metal oxide in the metal oxide electrolyte precursor 102 (based on a total weight of the metal oxide electrolyte precursor 102). For example, a metal oxide electrolyte precursor 102 comprising 15 wt % MgO based on a total weight of the metal oxide electrolyte precursor 102 may be conditioned 104 by adding MgO in a sufficient amount to increase the MgO concentration by 3 wt % to yield a metal oxide electrolyte comprising 18 wt % MgO based on a total weight of the metal oxide electrolyte. In another example, a metal oxide electrolyte precursor 102 comprising 15 wt % $Al_2O_3$ and 5 wt % $SiO_2$ based on a total weight of the metal oxide electrolyte precursor 102 may be conditioned 104 by adding an aluminosilicate (and optionally alumina and/or silica) in a sufficient amount to increase the $Al_2O_3$ concentration by 5 wt % and the $SiO_2$ by 3 wt % to yield a metal oxide electrolyte comprising 20 wt % $Al_2O_3$ and 8 wt % $SiO_2$ based on a total weight of the metal oxide electrolyte. In yet another example, a metal oxide electrolyte precursor 102 comprising 8 wt % $Al_2O_3$ and 1 wt % $Nb_2O_5$ based on a total weight of the metal oxide electrolyte precursor 102 may be conditioned 104 by adding alumina in a sufficient amount to increase the $Al_2O_3$ concentration by 5 wt % and by adding a metal oxide concentrate comprising at least 50 wt % $Nb_2O_5$ in a sufficing amount to increase the $Nb_2O_5$ by 4 wt % to yield a metal oxide electrolyte comprising 13 wt % $Al_2O_3$ and 5 wt % $Nb_2O_5$ based on a total weight of the metal oxide electrolyte.

Decreasing the concentration of a metal oxide may include smelting the metal oxide electrolyte precursor 102 and optionally refining the metal oxide electrolyte precursor 102. Preferably, smelting and optionally refining reduce the concentration of a metal oxide that may have deleterious effects in the downstream molten oxide electrolysis 108 or molten oxide electrolysis reactor. For example, low boiling metals like lead and zinc may reduce at the anode and then vaporize before reoxidizing in the exhaust of the molten oxide electrolysis reactor. The condensed metal oxide can clog the exhaust and reduce (or stop) the flow capacity for the gas produced during the molten oxide electrolysis 108. The concentration of a metal oxide may also be decreased by the additions of oxides and/or oxides concentrate additives to the metal oxide electrolyte precursor, to dilute said metal oxide.

Smelting may comprise heating the metal oxide electrolyte precursor 102 in the presence of a reducing agent to a temperature sufficient to melt the metal oxide electrolyte precursor 102, reduce the desired metal oxide, and cause a density separation between the molten metal oxides and a reduced metal. When a metal oxide concentration is decreased, the concentration decrease may be 0.5 wt % to 20 wt % (or 0.5 wt % to 10 wt %, or 1 wt % to 5 wt %, or 5 wt % to 15 wt %, or 10 wt % to 20 wt %), calculated as the wt % of said metal oxide in the metal oxide electrolyte precursor 102 (based on a total weight of the metal oxide electrolyte precursor 102) minus the wt % of said metal oxide in the metal oxide electrolyte (based on a total weight of the metal oxide electrolyte). For example, a metal oxide electrolyte precursor 102 comprising 5 wt % ZnO based on a total weight of the metal oxide electrolyte precursor 102 may be conditioned 104 by smelting and optionally refining to decrease the ZnO concentration by 4 wt % to yield a metal oxide electrolyte comprising 1 wt % ZnO based on a total weight of the metal oxide electrolyte.

A combination of the foregoing conditioning 104 methods to change the concentration of multiple metal oxides may be used. For example, a metal oxide electrolyte precursor 102 comprising 10 wt % MgO and 3 wt % ZnO based on a total weight of the metal oxide electrolyte precursor 102 may be conditioned 104 by (a) adding MgO in a sufficient concentration to increase the MgO concentration by 5 wt % and (b) smelting and optionally refining to decrease the ZnO concentration by at least 2.5 wt % to yield a metal oxide electrolyte comprising 15 wt % MgO and 0.5 wt % or less ZnO based on a total weight of the metal oxide electrolyte.

When two or more of the foregoing conditioning 104 methods are used, the adding of the metal oxide additive, the adding of the metal oxide concentrate, and the smelting and optionally refining may occur in any suitable order.

The conditioning 104 produces a metal oxide electrolyte 106 suitable for molten oxide electrolysis 108. In the molten oxide electrolysis 108, current flows between an anode through the molten electrolyte 106 and a molten metal cathode. Operational conditions may be selected to facilitate reduction of the metal oxide(s) corresponding to one or more target metals. The metal oxide electrolyte 106 may comprise the metal oxide, and the corresponding target metal may be 0.5 wt % to 20 wt % (or 0.5 wt % to 3 wt %, or 1 wt % to 5 wt %, or 3 wt % to 10 wt %, or 5 wt % to 15 wt %, or 10 wt % to 20 wt %), based on a total weight to the spent electrolyte 110. When there is more than one target metal the foregoing ranges apply to each target metal individually.

The anode may be formed of an inert material or carbon-based materials (e.g., graphite). With inert anodes, metal oxide reduction produces the corresponding metal and oxygen gas. With carbon-based anodes, metal oxide reduction produces the corresponding metal and a gas comprising carbon monoxide and/or carbon dioxide and potentially oxygen.

The cathode may comprise one or more of: iron and nickel. For the molten oxide electrolysis, the cathode may incorporate the metal corresponding to the target metal being extracted in the molten oxide electrolysis 108. For example, if the metal oxide electrolyte includes SnO where tin is the desired metal to be extracted, the molten cathode prior to electrolysis beginning may include an amount of tin along with iron and/or nickel.

The operational conditions of the molten oxide electrolysis 108 may vary based on, among other things, the anode composition, the cathode composition, the metal oxide electrolyte composition, the configuration of the molten oxide electrolysis reactor, and the one or more target metals. For example, molten oxide electrolysis 108 may be performed with a cathode current density ranging from 0.1 $A/cm^2$ to 60 $A/cm^2$ (or from 0.1 $A/cm^2$ to 20 $A/cm^2$, or from 0.5 $A/cm^2$ to 40 $A/cm^2$, or from 5 $A/cm^2$ to 60 $A/cm^2$), a voltage difference between the anode and the cathode of 1 V to 130 V (or 1 V to 50 V, or 25 V to 100 V, or 75 V to 130 V), and a temperature of the molten metal oxide electrolyte of 1000° C. to 2200° C. (or 1000° C. to 1500° C., or 1250° C. to 1750° C., or 1500° C. to 2200° C.). Values outside the foregoing ranges are contemplated.

The source of the electricity may be any suitable electrical source. Examples of electricity sources may include, but are not limited to, renewable energy sources (e.g., solar, wind, biomass, hydropower, and geothermal), fossil fuels (e.g., coal, natural gas, and petroleum), nuclear energy, the like, and any combination thereof.

After completion of the electrolysis, the cathode material and the electrolyte may be removed (e.g., using tapping) to produce a metal product 112 and spent electrolyte 110, respectively.

The spent electrolyte 110 has a reduced concentration of at least one metal oxide as compared to a concentration of the at least one metal oxide in the metal oxide electrolyte 106. The spent electrolyte 110 may comprise the metal oxide corresponding to a target metal in an amount from 0 wt % to 3 wt % (or 0 wt % to 0.001 wt %, or 0.001 wt % to 0.1 wt %, or 0.01 wt % to 0.05 wt %, or 0 wt % to 0.1 wt %, or 0 wt % to 0.5 wt %, or 0.5 wt % to 3 wt %), based on a total weight to the spent electrolyte 110. When there is more than one target metal, the foregoing ranges apply to each target metal individually.

The metal product 112 comprises the metal of the at least one metal oxide. The metal product 112 may be an alloy of the metals of the cathode and the metals extracted from the metal oxide electrolyte 106. The metal product 112 may comprise the metal of the cathode at 50 wt % to 90 wt % (or 50 wt % to 75 wt %, or 60 wt % to 80 wt %, or 75 wt % to 90 wt %) and the extracted metals cumulatively at 10 wt % to 50 wt % (or 25 wt % to 50 wt %, or 20 wt % to 40 wt %, or 10 wt % to 25 wt %), based on a total weight of the metal product 112.

Nonlimiting, examples of molten oxide electrolysis reactors and processes are disclosed in U.S. Pat. Nos. 11,591,703 and 11,591,704 and U.S. Patent App. Pub. No. 2019/0186834, each of which is incorporated herein by reference.

Figure 2:
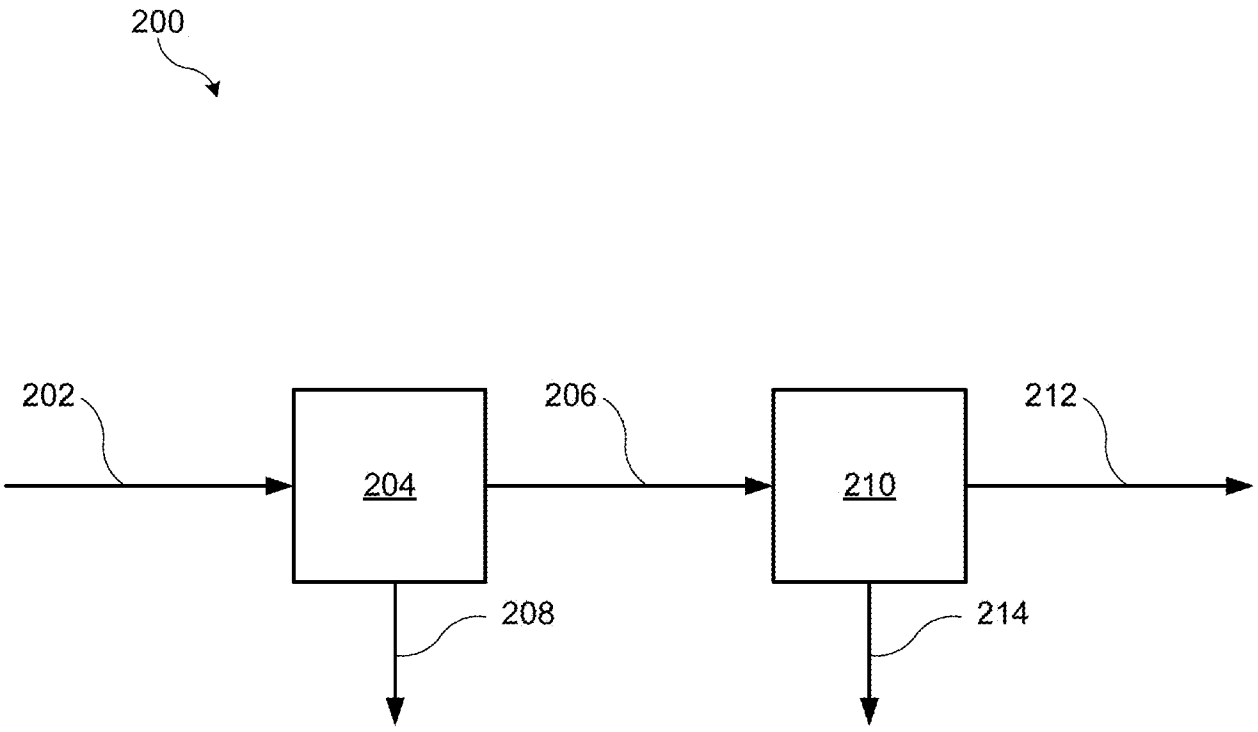
FIG. 2 is a flow diagram of a nonlimiting example of a method of the present disclosure for extracting metals from a metal oxide source (e.g., a complex metal oxide feedstock) where molten oxide electrolysis is performed more than once.

Optionally (for example as illustrated in FIG. 2), the molten oxide electrolysis may comprise a first molten oxide electrolysis, and the spent electrolyte 110 may be used as a metal oxide electrolyte in a second molten oxide electrolysis.

Thus, the methods and systems of the present disclosure may include two or more molten oxide electrolysis processes or reactors in series where each of the molten oxide electrolysis processes or reactors are at conditions to extract different metals from the molten metal oxide electrolyte. The target metal(s) for each molten oxide electrolysis process or reactor may be chosen such that the target metal(s) in a molten oxide electrolysis process or reactor has a $\Delta G_f$ at 1500° C. that is at least 15 KJ/mole $O_2$ greater than (or at least 20 KJ/mole $O_2$ greater than, or at least 30 KJ/mole $O_2$ greater than, or at least 50 KJ/mole $O_2$ greater than, or 15 KJ/mole $O_2$ to 500 KJ/mole $O_2$, or 15 KJ/mole $O_2$ to 100 KJ/mole $O_2$, or 15 KJ/mole $O_2$ to 50 kJ/mole $O_2$) a $\Delta G_f$ of the target metal oxide(s) at 1500° C. in the immediately succeeding molten oxide electrolysis process or reactor. The methods and systems of in this aspect of the disclosure (where the electrolysis comprises two or more molten oxide electrolysis processes or reactors in series) may or may not be combined with one or more of the conditioning steps for modifying the physical properties and/or chemical composition of the metal oxide electrolyte precursor, as described above.

FIG. 2 is a flow diagram of a nonlimiting example of a method 200 of the present disclosure for extracting metals from a metal oxide feedstock where molten oxide electrolysis is performed more than once. In the illustrated example, the metal oxide feedstock may or may not be a complex metal oxide feedstock. Whether the metal oxide feedstock is a complex or not, conditioning may optionally (not illustrated) be added upstream of the first molten oxide electrolysis 204.

In the illustrated example, a first metal oxide electrolyte 202 (the metal oxide feedstock or a conditioned metal oxide feedstock) undergoes a first molten oxide electrolysis 204 to produce a first spent electrolyte 206 and a first metal product 208. The operational parameters of the first molten oxide electrolysis 204 may be chosen to extract one or more first target metals from the first metal oxide electrolyte 202. The first metal product 208 comprises the one or more first target metals, and the first spent electrolyte 206 has a lower concentration of one or more metal oxides corresponding to the one or more first target metals as compared to the first metal oxide electrolyte 202.

The first spent electrolyte 206 is then used as the electrolyte in a second molten oxide electrolysis 210 to produce a second spent electrolyte 212 and a second metal product 214. The first spent electrolyte 206 composition may be adjusted prior to or in the second molten oxide electrolyte 210 if necessary for process operations. The operational parameters of the second molten oxide electrolysis 210 may be chosen to extract one or more second target metals from the first spent electrolyte 206. The second metal product 214 comprises the one or more second target metals, and the second spent electrolyte 212 has a lower concentration of one or more metal oxides corresponding to the one or more second target metals as compared to the first spent electrolyte 206.

The metal oxide(s) of the one or more first target metals of the first metal oxide electrolyte 202 may have a $\Delta G_f$ at 1500° C. that is at least 15 KJ/mole of $O_2$ greater than (or at least 20 KJ/mole $O_2$ greater than, or at least 30 KJ/mole $O_2$ greater than, or at least 50 KJ/mole $O_2$ greater than, or 15 KJ/mole $O_2$ to 500 KJ/mole 02, or 15 KJ/mole $O_2$ to 100 KJ/mole 02, or 15 KJ/mole $O_2$ to 50 KJ/mole $O_2$) a $\Delta G_f$ at 1500° C. of any of the metal oxides corresponding to the one or more second target metals of the first spent electrolyte 206.

The operational parameters, and the concept of adjusting said parameters, of the molten oxide electrolysis described above relative to FIG. 1 apply to the first molten oxide electrolysis 204 and the second molten oxide electrolysis 210.

Any suitable number of molten oxide electrolysis processes or reactors may be placed in series. Conditioning may optionally be performed before any molten oxide electrolysis, including between two molten oxide electrolysis processes where a series of multiple molten oxide electrolysis processes are implemented.

Figure 3:
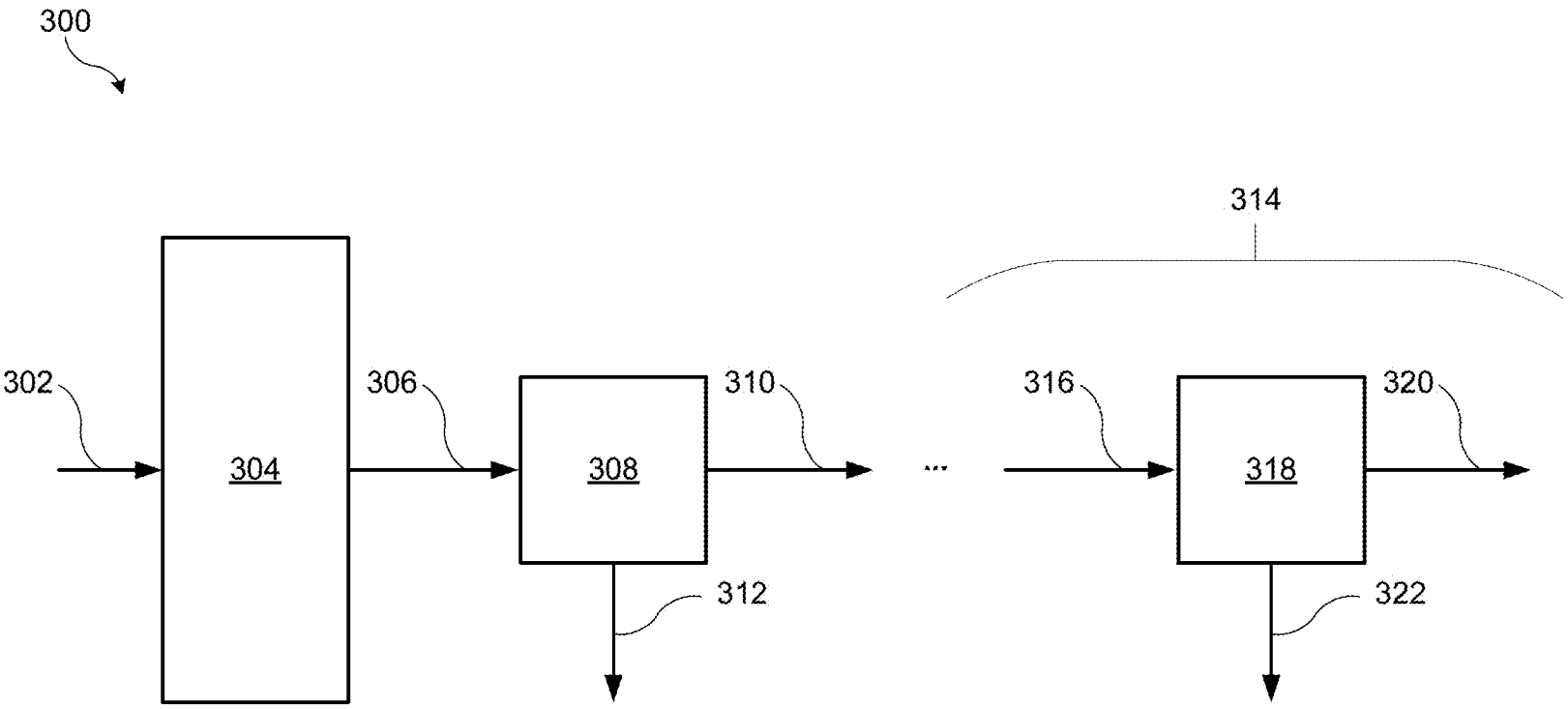
FIG. 3 is a flow diagram of another nonlimiting example of a method of the present disclosure for extracting metals from a metal oxide feedstock (e.g., a complex metal oxide feedstock) where molten oxide electrolysis is performed more than once.

FIG. 3 is a flow diagram of another nonlimiting example of a method 300 of the present disclosure for extracting metals from a metal oxide feedstock where molten oxide electrolysis is performed more than once. In this example, the metal oxide feedstock (whether complex or otherwise) is conditioned 304 before performing a series of molten oxide electrolysis processes 308, 318.

The illustrated method 300 includes conditioning 304 the metal oxide electrolyte precursor 302, which in this example is the metal oxide feedstock, to produce a metal oxide electrolyte 306. The conditioning 104 described relative to FIG. 1 applies to the condition 304 of FIG. 3. The metal oxide electrolyte 306 is then used as the electrolyte in the molten oxide electrolysis 308 to produce a first spent electrolyte 310 and a metal product 312.

One or more additional molten oxide electrolysis processes 314 may be carried out in series where each molten oxide electrolysis uses the spent electrolyte (optionally after having been conditioned) from the foregoing molten oxide electrolysis where metal oxides having higher $\Delta G_f$ at 1500° C. are preferentially reduced in each respective oxide electrolysis processes before metal oxides having lower $\Delta G_f$ at 1500° C.

The number of sequential molten oxide electrolysis processes may range from 2 to 20 or more (or 2 to 10, or 2 to 5, or 3 to 8 or 5 to 15, or 5 to 20 or more).

The illustrated method 300 continues through n number of molten oxide electrolysis processes where an $n^{th}-1$ spent electrolyte 316 is used as the electrolyte in an $n^{th}$ molten oxide electrolysis 318 to produce (a) an $n^{th}$ spent electrolyte 320 having a reduced concentration of an $n^{th}$ metal oxide as compared to the concentration of the $n^{th}$ metal oxide in the $n^{th}-1$ spent electrolyte 316 and (b) an $n^{th}$ metal product 320 comprising the metal of the $n^{th}$ metal oxide.

The description of the metal oxide electrolyte 106, the molten oxide electrolysis 108, the spent metal electrolyte 110, and the metal product 112 applies to the corresponding name references in FIG. 3.

CLAUSES

Clause 1. A method for performing molten oxide electrolysis, the method comprising: providing a metal oxide electrolyte precursor comprising at least three metal oxides, each present at 0.5 wt % or greater based on a total weight of the metal oxide electrolyte precursor; conditioning the metal oxide electrolyte precursor, to produce a metal oxide electrolyte, wherein the conditioning comprises at least one of: (a) changing a concentration of at least one the at least three metal oxides in the metal oxide electrolyte precursor and (b) changing a concentration of at least one metal in a metal oxide electrolyte precursor; and performing molten oxide electrolysis on the metal oxide electrolyte as an electrolyte to produce (a) a spent electrolyte having a reduced concentration of a first metal oxide of the at least three metal oxides as compared to a concentration of the first metal oxide in the metal oxide electrolyte, and (b) a metal product comprising a first metal of the first metal oxide.

Clause 2. The method of Clause 1, wherein the at least three metal oxides, each present at 0.5 wt % or greater is at least six metal oxides, each present at 0.5 wt % or greater based on a total weight of the metal oxide electrolyte precursor.

Clause 3. The method of Clause 2, wherein the at least three metal oxides, each present at 0.5 wt % or greater includes (a) a first metal oxide present at 4 wt % or greater, (b) a second metal oxide and a third metal oxide each present at 1 wt % or greater, and (c) at least four additional metal oxides, each present at 0.5 wt % or greater, each based on a total weight of the metal oxide electrolyte precursor.

Clause 4. The method of any one of Clauses 1-3, wherein a cathode of the molten oxide electrolysis comprises iron in a molten state, and wherein the first metal product comprises an iron niobium alloy, an iron tantalum alloy, or an iron chromium alloy.

Clause 5. The method of any one of Clauses 1-4, wherein the at least three metal oxides comprises 25 wt % to 35 wt % MnO, 25 wt % to 35 wt % $SiO_2$, 25 wt % to 35 wt % CaO, 5 wt % to 10 wt % MgO, 2 wt % to 10 wt % $Al_2O_3$, and 0.5 wt % to 3 wt % FeO, and wherein the first metal oxide is the MnO.

Clause 6. The method of any one of Clauses 1-4, wherein the at least three metal oxides comprises 0.5 wt % to 20 wt % $Nb_2O_5$, 25 wt % to 35 wt % $SiO_2$, 1 wt % to 25 wt % $ZrO_2$, 10 wt % to 25 wt % CaO, 0.5 wt % to 10 wt % MgO, 1 wt % to 15 wt % $Al_2O_3$, 0.5 wt % to 10 wt % $Fe_2O_3$, 1 wt % to 10 wt % $TiO_2$ and 0.5 wt % to 3 wt % $Ta_2O_5$, and wherein the first metal oxide is the $Nb_2O_5$.

Clause 7. The method of any one of Clauses 4-6, wherein a cathode of the molten oxide electrolysis comprises iron in a molten state, and wherein the first metal product comprises an iron manganese alloy.

Clause 8. The method of any one of Clauses 1-7, wherein the metal oxide electrolyte comprises at least one of: a mining or metallurgical waste, a metal ore concentrate, or a metal ore.

Clause 9. The method of any one of Clauses 1-8, wherein the metal oxide electrolyte comprises a metal not as a metal oxide at 0.5 wt % to 20 wt %.

Clause 10. The method of any one of Clauses 1-9, wherein the changing of the concentration of one or more of the at least three metal oxides from the metal oxide electrolyte precursor comprises smelting the metal oxide electrolyte precursor and optionally refining the metal oxide electrolyte precursor.

Clause 11. The method of any one of Clauses 1-10, wherein the changing of the concentration of one or more of the at least three metal oxides from the metal oxide electrolyte precursor comprises adding one or more metal oxide additive to the metal oxide electrolyte precursor.

Clause 12. The method of Clause 11, wherein the metal oxide additives comprise one or more of: titanium oxide, silicon oxide, magnesium oxide, aluminum oxide, calcium oxide, lime, limestone, an aluminosilicate, a magnesium aluminosilicate, a magnesium silicate, a borosilicate, an iron oxide, and any combination thereof.

Clause 13. The method of any one of Clauses 1-13, wherein the changing of the concentration of the at least one metal oxide in a metal oxide electrolyte precursor comprises adding a metal oxide concentrate of the first metal oxide.

Clause 14. The method of any one of Clauses 1-13, wherein the molten oxide electrolysis is a first molten oxide electrolysis, the spent electrolyte is a first spent electrolyte, and the metal product is a first metal product, and wherein the method further comprises: performing a second molten oxide electrolysis on the first spent electrolyte as an electrolyte to produce (a) a second spent electrolyte having a reduced concentration of a second metal oxide of the at least three metal oxides as compared to a concentration of the second metal oxide in the first spent electrolyte, and (b) a metal product comprising a second metal of the second metal oxide, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C.

Clause 15. The method of Clause 14, wherein a cathode of the molten oxide electrolysis comprises iron in a molten state, and wherein the second metal product comprises an iron niobium alloy, an iron tantalum alloy, or an iron chromium alloy.

Clause 16. A method for extracting metal from a complex metal oxide electrolyte, the method comprising: changing the concentration of at least one metal oxide in a metal oxide electrolyte precursor comprising at least three metal oxides, each present at 0.5 wt % or greater based on a total weight of the metal oxide electrolyte precursor, to produce a metal oxide electrolyte; and performing electrolysis with the metal oxide electrolyte in a molten oxide electrolysis unit to extract a metal of one or more of the metal oxides of the metal oxide electrolyte.

Clause 17. A method for performing molten oxide electrolysis, the method comprising: providing a metal oxide electrolyte comprising a first metal oxide, a second metal oxide, and a third metal oxide, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C.; performing a first molten oxide electrolysis on the metal oxide electrolyte to produce (a) a first spent electrolyte comprising the second metal oxide and the third metal oxide and having a reduced concentration of the first metal oxide as compared to a concentration of the first metal oxide in the metal oxide electrolyte, and (b) a first metal product comprising a first metal of the first metal oxide; and performing a second molten oxide electrolysis on the first spent electrolyte to produce (a) a second spent electrolyte comprising the third metal oxide and a reduced concentration of the second metal oxide as compared to a concentration of the second metal oxide in the first spent electrolyte, and (b) a second metal product comprising a second metal of the second metal oxide.

Clause 18. A method for performing molten oxide electrolysis, the method comprising: providing a metal oxide electrolyte comprising a first metal oxide, a second metal oxide, and a third metal oxide, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C., and wherein a $\Delta G_f$ of the second metal oxide at 1500° C. is at least 15 KJ/mole of $O_2$ greater than the $\Delta G_f$ of the third metal oxide at 1500° C.; performing a first molten oxide electrolysis on the metal oxide electrolyte to produce (a) a first spent electrolyte comprising the second metal oxide and the third metal oxide and having a reduced concentration of the first metal oxide as compared to a concentration of the first metal oxide in the metal oxide electrolyte, and (b) a first metal product comprising a first metal of the first metal oxide; and performing a second molten oxide electrolysis on the first spent electrolyte to produce (a) a second spent electrolyte comprising the third metal oxide and a reduced concentration of the second metal oxide as compared to a concentration of the second metal oxide in the first spent electrolyte, and (b) a second metal product comprising a second metal of the second metal oxide.

Clause 19. The method of any one of Clauses 17-18, wherein the metal oxide electrolyte comprises at least three metal oxides, each present at 0.5 wt % or greater based on a total weight of the metal oxide electrolyte, and wherein the at least three metal oxides include the first metal oxide, the second metal oxide, and the third metal oxide.

Clause 20. The method of any one of Clauses 17-19, wherein the metal oxide electrolyte comprises at least one of: a mining or metallurgical waste, a metal ore concentrate, or a metal ore.

Clause 21. The method of any one of Clauses 17-20 further comprising: conditioning a metal oxide electrolyte precursor, to produce the metal oxide electrolyte, wherein the conditioning comprises at least one of: (a) changing a concentration of a fourth metal oxide in the metal oxide electrolyte precursor, and (b) changing a concentration of a metal in the metal oxide electrolyte precursor.

Clause 22. The method of any one of Clauses 17-21, wherein the method continues through n number of molten oxide electrolysis processes where an $n^{th}-1$ spent electrolyte is used as the electrolyte in an $n^{th}$ molten oxide electrolysis to produce (a) an $n^{th}$ spent electrolyte having a reduced concentration of an $n^{th}$ metal oxide as compared to the concentration of the $n^{th}$ metal oxide in the $n^{th}-1$ spent electrolyte and (b) an $n^{th}$ metal product 320 comprising the metal of the $n^{th}$ metal oxide.

Clause 23. A molten oxide electrolysis process, comprising: performing electrolysis with a metal oxide electrolyte in a plurality of molten oxide electrolysis units connected in series, wherein each molten oxide electrolysis unit forms a respective metal product stream, and wherein metal oxides having higher Gibbs free energy of formation ($\Delta G_f$) at 1500° C. are preferentially reduced in each respective molten oxide electrolysis unit before metal oxides having lower $\Delta G_f$ at 1500° C.

Clause 24. A method for performing molten oxide electrolysis, the method comprising: providing a metal oxide electrolyte precursor comprising at least six metal oxides, each present at 1 wt % or greater based on a total weight of the metal oxide electrolyte precursor; conditioning the metal oxide electrolyte precursor, to produce a metal oxide electrolyte, wherein the conditioning comprises at least one of: (a) changing a concentration of at least one the at least six metal oxides in the metal oxide electrolyte precursor and (b) changing a concentration of at least one metal in a metal oxide electrolyte precursor; and performing molten oxide electrolysis on the metal oxide electrolyte as an electrolyte to produce (a) a spent electrolyte having a reduced concentration of a first metal oxide of the at least six metal oxides as compared to a concentration of the first metal oxide in the metal oxide electrolyte, and (b) a metal product comprising a first metal of the first metal oxide.

Clause 25. The method of Clause 24, wherein the at least six metal oxides, each present at 1 wt % or greater is at least ten metal oxides, each present at 1 wt % or greater based on a total weight of the metal oxide electrolyte precursor.

Clause 26. The method of Clause 25, wherein the at least six metal oxides, each present at 1 wt % or greater includes (a) a first metal oxide present at 20 wt % or greater, (b) a second metal oxide and a third metal oxide each present at 10 wt % or greater, and (c) at least four additional metal oxides, each present at 1 wt % or greater, each based on a total weight of the metal oxide electrolyte precursor.

Clause 27. The method of any one of Clauses 24-26, wherein a cathode of the molten oxide electrolysis comprises iron in a molten state, and wherein the first metal product comprises an iron niobium alloy, an iron tantalum alloy, or an iron chromium alloy.

Clause 28. The method of any one of Clauses 24-27, wherein the at least six metal oxides include comprises 25 wt % to 35 wt % MnO, 25 wt % to 35 wt % $SiO_2$, 25 wt % to 35 wt % CaO, 5 wt % to 10 wt % MgO, 2 wt % to 10 wt % $Al_2O_3$, and 0.5 wt % to 3 wt % FeO, and wherein the first metal oxide is the MnO.

Clause 29. The method of any one of Clauses 24-27, wherein the at least three metal oxides comprises 0.5 wt % to 20 wt % $Nb_2O_5$, 25 wt % to 35 wt % $SiO_2$, 1 wt % to 25 wt % $ZrO_2$, 10 wt % to 25 wt % CaO, 0.5 wt % to 10 wt % MgO, 1 wt % to 15 wt % $Al_2O_3$, 0.5 wt % to 10 wt % $Fe_2O_3$, 1 wt % to 10 wt % $TiO_2$ and 0.5 wt % to 3 wt % $Ta_2O_5$, and wherein the first metal oxide is the $Nb_2O_5$.

Clause 30. The method of any one of Clauses 27-29, wherein a cathode of the molten oxide electrolysis comprises iron in a molten state, and wherein the first metal product comprises an iron manganese alloy.

Clause 31. The method of any one of Clauses 24-30, wherein the metal oxide electrolyte comprises at least one of: a mining or metallurgical waste, a metal ore concentrate, or a metal ore.

Clause 32. The method of any one of Clauses 24-31, wherein the metal oxide electrolyte comprises a metal not as a metal oxide at 0.5 wt % to 20 wt %.

Clause 33. The method of any one of Clauses 24-32, wherein the changing of the concentration of one or more of the at least six metal oxides from the metal oxide electrolyte precursor comprises smelting the metal oxide electrolyte precursor and optionally refining the metal oxide electrolyte precursor.

Clause 34. The method of any one of Clauses 24-33, wherein the changing of the concentration of one or more of the at least six metal oxides from the metal oxide electrolyte precursor comprises adding a metal oxide additive to the metal oxide electrolyte precursor.

Clause 35. The method of Clause 34, wherein the metal oxide additive comprises one or more of: titanium oxide, silicon oxide, magnesium oxide, aluminum oxide, calcium oxide, lime, limestone, an aluminosilicate, a magnesium aluminosilicate, a magnesium silicate, a borosilicate, an iron oxide, and any combination thereof.

Clause 36. The method of any one of Clauses 24-35, wherein the changing of the concentration of the at least one metal oxide in a metal oxide electrolyte precursor comprises adding a metal oxide concentrate of the first metal oxide.

Clause 37. The method of any one of Clauses 24-36, wherein the molten oxide electrolysis is a first molten oxide electrolysis, the spent electrolyte is a first spent electrolyte, and the metal product is a first metal product, and wherein the method further comprises: performing a second molten oxide electrolysis on the first spent electrolyte as an electrolyte to produce (a) a second spent electrolyte having a reduced concentration of a second metal oxide of the at least six metal oxides as compared to a concentration of the second metal oxide in the first spent electrolyte, and (b) a metal product comprising a second metal of the second metal oxide, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C.

Clause 38. The method of Clause 37, wherein a cathode of the molten oxide electrolysis comprises iron in a molten state, and wherein the second metal product comprises an iron niobium alloy, an iron tantalum alloy, or an iron chromium alloy.

Clause 39. A method for extracting metal from a complex metal oxide electrolyte, the method comprising: changing a concentration of at least one metal oxide in a metal oxide electrolyte precursor comprising at least six metal oxides, each present at 1 wt % or greater based on a total weight of the metal oxide electrolyte precursor, to produce a metal oxide electrolyte; and performing electrolysis with the metal oxide electrolyte in a molten oxide electrolysis unit to extract a metal of one or more of the metal oxides of the metal oxide electrolyte.

Clause 40. A method for performing molten oxide electrolysis, the method comprising: providing a metal oxide electrolyte comprising a first metal oxide, a second metal oxide, and a third metal oxide, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C.; performing a first molten oxide electrolysis on the metal oxide electrolyte to produce (a) a first spent electrolyte comprising the second metal oxide and the third metal oxide and having a reduced concentration of the first metal oxide as compared to a concentration of the first metal oxide in the metal oxide electrolyte, and (b) a first metal product comprising a first metal of the first metal oxide; and performing a second molten oxide electrolysis on the first spent electrolyte to produce (a) a second spent electrolyte comprising the third metal oxide and a reduced concentration of the second metal oxide as compared to a concentration of the second metal oxide in the first spent electrolyte, and (b) a second metal product comprising a second metal of the second metal oxide.

Clause 41. A method for performing molten oxide electrolysis, the method comprising: providing a metal oxide electrolyte comprising a first metal oxide, a second metal oxide, and a third metal oxide, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C., and wherein a $\Delta G_f$ of the second metal oxide at 1500° C. is at least 15 KJ/mole of $O_2$ greater than the $\Delta G_f$ of the third metal oxide at 1500° C.; performing a first molten oxide electrolysis on the metal oxide electrolyte to produce (a) a first spent electrolyte comprising the second metal oxide and the third metal oxide and having a reduced concentration of the first metal oxide as compared to a concentration of the first metal oxide in the metal oxide electrolyte, and (b) a first metal product comprising a first metal of the first metal oxide; and performing a second molten oxide electrolysis on the first spent electrolyte to produce (a) a second spent electrolyte comprising the third metal oxide and a reduced concentration of the second metal oxide as compared to a concentration of the second metal oxide in the first spent electrolyte, and (b) a second metal product comprising a second metal of the second metal oxide.

Clause 42. The method of any one of Clauses 40-41, wherein the metal oxide electrolyte comprises at least six metal oxides, each present at 1 wt % or greater based on a total weight of the metal oxide electrolyte, and wherein the at least six metal oxides includes the first metal oxide, the second metal oxide, and the third metal oxide.

Clause 43. The method of any one of Clauses 40-42, wherein the metal oxide electrolyte comprises at least one of: a mining or metallurgical waste, a metal ore concentrate, or a metal ore.

Clause 44. The method of any one of Clauses 40-43 further comprising: conditioning a metal oxide electrolyte precursor, to produce the metal oxide electrolyte, wherein the conditioning comprises at least one of: (a) changing a concentration of a fourth metal oxide in the metal oxide electrolyte precursor, and (b) changing a concentration of a metal in the metal oxide electrolyte precursor.

Clause 45. The method of any one of Clauses 40-44, wherein the method continues through n number of molten oxide electrolysis processes where an $n^{th}-1$ spent electrolyte is used as the electrolyte in an $n^{th}$ molten oxide electrolysis to produce (a) an $n^{th}$ spent electrolyte having a reduced concentration of an $n^{th}$ metal oxide as compared to the concentration of the $n^{th}$ metal oxide in the $n^{th}-1$ spent electrolyte and (b) an $n^{th}$ metal product 320 comprising the metal of the $n^{th}$ metal oxide.

Clause 46. A molten oxide electrolysis process, comprising: performing electrolysis with a metal oxide electrolyte in a plurality of molten oxide electrolysis units connected in series, wherein each molten oxide electrolysis unit forms a respective metal product stream, and wherein metal oxides having higher Gibbs free energy of formation ($\Delta G_f$) at 1500° C. are preferentially reduced in each respective molten oxide electrolysis unit before metal oxides having lower $\Delta G_f$ at 1500° C.

EXAMPLES

A metal oxide electrolyte was prepared using a metallurgical waste (the metal oxide feedstock) which contained less than 3 wt % of the oxide of the metal target.

The metallurgical waste was conditioned by adding (a) a metal oxide additive (specifically, 60:40 weight ratio of $Al_2O_3$:CaO), and (b) a target metal oxide concentrate (specifically, a $Nb_2O_5$ concentrate comprising >50 wt % $Nb_2O_5$) to produce a metal oxide electrolyte.

A first charge of metal oxide electrolyte was added to the molten oxide electrolysis reactor and heated. Then, molten oxide electrolysis was performed for about 36 hours and at a temperature of about 1700° C. to about 1740° C. During the molten oxide electrolysis, additional metal oxide electrolyte and target metal concentrate was added as the $Nb_2O_5$ concentration decreased.

Although not conducted in this example, the spent electrolyte from the performed molten oxide electrolysis could be removed from the molten oxide electrolysis reactor, optionally conditioned, and used as the electrolyte in a second molten oxide electrolysis.

Unless otherwise indicated, all numbers expressing quantities of ingredients, properties (e.g., molecular weight), reaction conditions, and the like used in the present disclosure and associated claims are to be understood as being modified in all instances by the term "about." At the very least, and not as an attempt to limit the application of the doctrine of equivalents to the scope of the claim, the term "about" relative to each numerical parameter should at least be construed in light of the number of reported significant digits and by applying ordinary rounding techniques.

A concentration range listed or described as being useful, suitable, or the like, is intended that any and every concentration within the range, including the end points, is to be considered as having been stated. For example, a range "from 1 to 10" is to be read as indicating each and every possible number along the continuum between about 1 and about 10. Thus, even if specific data points within the range, or even no data points within the range, are explicitly identified or refer to only a few specific data points, it is to be understood that inventors appreciate and understand that any and all data points within the range are to be considered to have been specified, and that inventors possessed knowledge of the entire range and all points within the range.

The term "and/or" refers to both the inclusive "and" case and the exclusive "or" case, and is used herein for brevity. For example, a mixture comprising acetic acid and/or methyl acetate may comprise acetic acid alone, methyl acetate alone, or both acetic acid and methyl acetate.

A listing following "one or more of" or "at least one of" using "and" to connect the listing is intended in the alternative or conjunctive rather than the disjunctive. For example, "at least one of: A, B, and C" and "one or more of: A, B, and C" are each considered to disclose embodiments of A alone, B alone, C alone, A and B in combination, A and C in combination, B and C in combination, and all three of A, B, and C in combination.

Room temperature is 25° C., and atmospheric pressure is 101.325 kPa unless otherwise noted.

While compositions, systems, and methods are described herein in terms of "comprising" various components or steps, the compositions, systems, and methods can also "consist essentially of" or "consist of" the various components and steps.

Illustrative embodiments of the invention are described herein. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

What is claimed is:

1. A method for performing molten oxide electrolysis, the method comprising:

providing a metal oxide electrolyte precursor comprising at least three metal oxides, each present at 0.5 wt % or greater based on a total weight of the metal oxide electrolyte precursor, wherein the at least three metal oxides comprises a first metal oxide of a first target metal and a second metal oxide of a second target metal;

conditioning the metal oxide electrolyte precursor, to produce a metal oxide electrolyte, wherein the conditioning comprises at least one of: (a) changing a concentration of at least one the at least three metal oxides in the metal oxide electrolyte precursor and (b) changing a concentration of at least one metal in a metal oxide electrolyte precursor;

performing a first molten oxide electrolysis on the metal oxide electrolyte as an electrolyte to produce (a) a first spent electrolyte comprising the second metal oxide and having a reduced concentration of a the first metal oxide as compared to a concentration of the first metal oxide in the metal oxide electrolyte, and (b) a first metal product comprising the first target metal; and performing a second molten oxide electrolysis on the first spent electrolyte to produce (a) a second spent electrolyte having a reduced concentration of the second metal oxide as compared to a concentration of the second metal oxide in the first spent electrolyte, and (b) a second metal product comprising the second target metal.

2. The method of claim 1, wherein the at least three metal oxides, each present at 0.5 wt % or greater is at least six metal oxides, each present at 0.5 wt % or greater based on a total weight of the metal oxide electrolyte precursor.

3. The method of claim 2, wherein the at least three metal oxides, each present at 0.5 wt % or greater includes (a) a third metal oxide present at 4 wt % or greater, (b) a fourth metal oxide and a fifth metal oxide each present at 1 wt % or greater, and (c) at least three additional metal oxides including the first metal oxide and the second metal oxide, each present at 0.5 wt % or greater, each based on a total weight of the metal oxide electrolyte precursor.

4. The method of claim 1, wherein a cathode of the molten oxide electrolysis comprises iron in a molten state, and wherein the first metal product comprises an iron niobium alloy, an iron tantalum alloy, or an iron chromium alloy.

5. The method of claim 1, wherein the at least three metal oxides comprises 0.5 wt % to 20 wt % $Nb_2O_5$, 25 wt % to 35 wt % $SiO_2$, 1 wt % to 25 wt % $ZrO_2$, 10 wt % to 25 wt % CaO, 0.5 wt % to 10 wt % MgO, 1 wt % to 15 wt % $Al_2O_3$, 0.5 wt % to 10 wt % $Fe_2O_3$, 1 wt % to 10 wt % $TiO_2$ and 0.5 wt % to 3 wt % $Ta_2O_5$, and wherein the first metal oxide is the $Nb_2O_5$.

6. The method of claim 1, wherein a cathode of the molten oxide electrolysis comprises iron in a molten state, and wherein the first metal product comprises an iron manganese alloy.

7. The method of claim 1, wherein the metal oxide electrolyte comprises at least one of: a mining or metallurgical waste, a metal ore concentrate, or a metal ore.

8. The method of claim 1, wherein the metal oxide electrolyte comprises a metal not as a metal oxide at 0.5 wt % to 20 wt %.

9. The method of claim 1, wherein the changing of the concentration of one or more of the at least three metal oxides from the metal oxide electrolyte precursor comprises smelting the metal oxide electrolyte precursor and optionally refining the metal oxide electrolyte precursor.

10. The method of claim 1, wherein the changing of the concentration of one or more of the at least three metal oxides from the metal oxide electrolyte precursor comprises adding one or more metal oxide additives to the metal oxide electrolyte precursor.

11. The method of claim 10, wherein the one or more metal oxide additives comprises one or more of: titanium oxide, silicon oxide, magnesium oxide, aluminum oxide, calcium oxide, lime, limestone, an aluminosilicate, a magnesium aluminosilicate, a magnesium silicate, a borosilicate, an iron oxide, and any naturally occurring or synthetically manufactured combination thereof.

12. The method of claim 1, wherein the changing of the concentration of the at least one metal in a metal oxide electrolyte precursor comprises adding a metal oxide concentrate of the first metal oxide.

13. The method of claim 1, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C.

14. The method of claim 13, wherein a cathode of the molten oxide electrolysis comprises iron in a molten state, and wherein the second metal product comprises an iron niobium alloy, an iron tantalum alloy, or an iron chromium alloy.

15. A method for performing molten oxide electrolysis, the method comprising:

providing a metal oxide electrolyte comprising a first metal oxide, a second metal oxide, and a third metal oxide, wherein the first metal oxide has a Gibbs free energy of formation ($\Delta G_f$) at 1500° C. that is at least 15 KJ/mole of $O_2$ greater than a $\Delta G_f$ of the second metal oxide at 1500° C., and wherein a $\Delta G_f$ of the second metal oxide at 1500° C. is at least 15 KJ/mole of $O_2$ greater than the $\Delta G_f$ of the third metal oxide at 1500° C.;

performing a first molten oxide electrolysis on the metal oxide electrolyte to produce (a) a first spent electrolyte comprising the second metal oxide and the third metal oxide and having a reduced concentration of the first metal oxide as compared to a concentration of the first metal oxide in the metal oxide electrolyte, and (b) a first metal product comprising a first metal of the first metal oxide; and performing a second molten oxide electrolysis on the first spent electrolyte to produce (a) a second spent electrolyte comprising the third metal oxide and a reduced concentration of the second metal oxide as compared to a concentration of the second metal oxide in the first spent electrolyte, and (b) a second metal product comprising a second metal of the second metal oxide.

16. The method of claim 15, wherein the metal oxide electrolyte comprises at least three metal oxides, each present at 0.5 wt % or greater based on a total weight of the metal oxide electrolyte, and wherein the at least three metal oxides includes the first metal oxide, the second metal oxide, and the third metal oxide.

17. The method of claim 15, wherein the metal oxide electrolyte comprises at least one of: a mining or metallurgical waste, a metal ore concentrate, or a metal ore.

18. The method of claim 15 further comprising:

conditioning a metal oxide electrolyte precursor, to produce the metal oxide electrolyte, wherein the conditioning comprises at least one of: (a) changing a concentration of a fourth metal oxide in the metal oxide electrolyte precursor, and (b) changing a concentration of a metal in the metal oxide electrolyte precursor.

19. A molten oxide electrolysis process, comprising:

performing electrolysis with a metal oxide electrolyte in a plurality of molten oxide electrolysis units connected in series, wherein each molten oxide electrolysis unit forms a respective metal product stream, and wherein metal oxides having higher Gibbs free energy of formation ($\Delta G_f$) at 1500°° C. are preferentially reduced in each respective molten oxide electrolysis unit before metal oxides having lower $\Delta G_f$ at 1500° C.

* * * * *